United States Patent [19]

Olander et al.

[11] Patent Number: 4,560,425

[45] Date of Patent: Dec. 24, 1985

[54] $LiClO_4$ CONTAINING PROPELLANT COMPOSITIONS

[75] Inventors: Donald E. Olander, Valencia, Calif.; Juho Hyyppa, 34110 Lakiala, Tampere City, Finland

[73] Assignee: Hi-Shear Corporation, Torrance, Calif. ; by said Donald E. Olander

[21] Appl. No.: 436,059

[22] Filed: Oct. 22, 1982

[51] Int. Cl.[4] ..... C06B 45/10

[52] U.S. Cl. ..... 149/19.91

[58] Field of Search ..... 149/19.91

[56] References Cited

U.S. PATENT DOCUMENTS

| | | | |
|---|---|---|---|
| 3,236,705 | 2/1966 | Gilman et al. | 149/19.91 |
| 3,523,840 | 8/1970 | Bedell | 149/19.91 |
| 3,537,922 | 11/1970 | Gilman et al. | 149/19.91 |
| 3,567,530 | 3/1971 | Lait et al. | 149/19.91 |
| 3,723,202 | 3/1973 | Butler et al. | 149/19.91 |
| 4,050,968 | 9/1977 | Goldhagen et al. | 149/19.91 |

*Primary Examiner*—Edward A. Miller

*Attorney, Agent, or Firm*—Donald D. Mon

[57] ABSTRACT

A curable energetic composition, comprising a hydroxyalkyl ester of acrylic or methacrylic acid, an organic polyol and lithium perchlorate, and optionally additional substances, is useful as a propellant.

1 Claim, No Drawings

$LiClO_4$ CONTAINING PROPELLANT COMPOSITIONS

FIELD OF THE INVENTION

This invention relates to compositions of matter which can be caused to release substantial amounts of energy, and to a method for making them.

BACKGROUND OF THE INVENTION

Many systems utilize compositions which, when ignited, release substantial amounts of energy. Objectives of all practical compositions of this type are to be shelf-stable; safely to be handled; readily to be formed to desirable shapes; and to be producible by processes which involve the least possible risk to the workers who manufacture it, and to the equipment and premises in which it is manufactured.

An additional conventional objective is to provide a ratio of available energy to the bulk or weight of the composition which is as large as possible. Yet another conventional objective is to use readily available and relatively inexpensive materials to form the composition.

There have been previous efforts to provide such compositions, and one such is shown in the presently co-pending U.S. patent application of one of the inventors herein, Ser. No. 409,147, filed Aug. 18, 1982, entitled "Energetic Compositions and Method for Making Them".

Compositions according to this invention fulfill the above objectives.

BRIEF DESCRIPTION OF THE INVENTION

An energetic composition according to this invention results from the process of forming a mixture of (1) an acrylic ester or an acrylic acid, or mixtures thereof having at least one hydroxyl group external to the acrylic acid group; (2) an ionic lithium salt which contains oxygen; and (3) an organic polyol, or mixtures thereof. The resulting composition tends to have a remarkably large specific impulse value.

According to a preferred but optional feature of the invention, the properties of the above mixture such as pliability and specific impulse can be pre-selected by adding reactive substances such as aluminium, lithium, RDX, HMX, and glycerol.

Energetic compositions according to this invention are produced by combining and curing a mixture of the following substances:

(1) an acrylic ester or an acrylic acid or mixture thereof having at least one hydroxyl group external to the acrylic acid group;

(2) an ionic lithium salt which contains oxygen; and (3) an organic polyol, or mixture of organic polyols.

The product is prepared by mixing these substances together and curing the mixture, or permitting it to cure.

Optionally, additional substances can be added to the mixture prior to curing which can alter its basic properties such as pliability and specific impulse. Examples are glycerol to make the product less "rubbery", and aluminium, lithium, RDX and HMX to increase the specific impulse.

DETAILED DESCRIPTION OF THE INVENTION

The precise chemical structure or identity of the energetic compositions according to this invention is not presently known, and such speculations as might be made herein concerning the structure or identity, or concerning the chemical processes which truly occur are not intended to be limitations on the invention. They constitute the inventors' best efforts to explain what they have been able to attain as actual compositions. Instead, with the present understanding of the processes, their chemistry, and the resulting energetic compositions, it is intended to describe ways of making these compositions, and the scope of the invention is intended to encompass these compositions, in whatever way they may be manufactured.

While absolute purity of the above substances is not essential, still, care will be taken to provide them without substances deleterious to the process or to the resulting energetic composition.

All acrylic esters and all acrylic acids known to the inventors which have at least one hydroxyl group external to the acrylic acid group appear to be effective for the purpose of this invention. The presently preferred such substance is 3 hydroxy propyl methacrylate. Other examples are "HEMA"—2 hydroxy ethyl methacrylate. The former is presently preferred.

Examples of ionic lithium salt which contain oxygen are lithium perchlorate and lithium nitrate. These are preferred not only because of their substantial oxygen content, but because of their relatively light weights.

Examples of suitable polyols are 1-mononitroglycerine; 2-mononitroglycerine, ethylene glycol, propylene glycol (1,2 propane diol), 1, 3 butane diol; 1, 4 butane diol; and in some circumstances, glycerol.

The method for making the composition is remarkably similar, whatever the substances used. However, the acrylic material and the polyol must be liquid or liquified so they can mix with one another. When both are liquids at room temperature, the process is no more complicated than merely stirring them together. If one or both are solid at room temperatures, then if the melting point is sufficiently low, the mixture will be heated to a temperature above the melting point. Alternatively, but less desirably, one or both could be dissolved in a suitable solvent. However, then the solvent must be removed, which requires another manufacturing step.

Best results appear to be obtained when the mole ratio between the acrylic substances and the polyol is 1:1. The substances are thoroughly mixed at room temperature. The process, whatever it is, appears to be accelerated if the stirring is done under vacuum, which need not be an especially high vacuum. The purpose is to draw air and moisture out of the mixture, and this appears to accelerate the thickening process, which appears to be one of condensation or polymerization. The vacuum is exerted for only a relatively short time, sufficient to remove most of the air and moisture.

Next, the lithium compound is added. It will be supplied as a finely ground crystal, as near to anhydrous as feasible. It is stirred into the mixture. Depending upon the compound which is sought to be made, the mole ratio of the lithium salt to the acrylic substance (and preferably also to the polyol) is about 3.0 or greater. When the ratio is about 1:1:3, the cured product is generally an optically clear product. When lithium salt in excess of this ratio is added there is a progression through opalescence to opacity.

The mixture of the three substances is stirred for about two hours, and then cast in a mold to the desired shape. Maintained at about 130° F. to about 150° F., the cure will take between about one and about three days.

Mixtures of various acrylic acids, acrylic esters, and mixtures of various acrylic acids and acrylic esters can be used. It is not necessary that only one such substance be used.

Mixtures of various polyols can be used. They need not all be the same type. It is not necessary that only one such substance be used.

The lithium salt is somehow "assimilated" into the mixture of acrylic and polyol substances. The mechanism and nature of the assimilation is not known. However, when the mole ratio is approximately 1:1:3, the optical clarity of the resulting product strongly suggests a solution of some kind, or some reaction. Lithium salt in excess is held in a matrix or some other type of suspension.

The properties of the product can be varied, not only by varying the relative proportions of the acrylic and polyol substances relative to each other, but by increasing the lithium salt content, or by adding other additives. As an example, if increased stiffness and physical strength is needed, more hydroxy groups can be added on the polyol. The polyol should be at least a diol, i.e. have at least two hydroxyl units.

Additional stiffness and specific impulse can be provided by increasing the lithium mole ratio above 3.0. It can be as high as 8.0 relative to either the acrylic or the polyol compositions.

The rubberyness of the product can be decreased by adding glycerine in the amount of about ½% by weight of the total mass.

All acrylic esters and acrylic acids known to the inventors which have at least one hydroxyl group external to the acrylic acid group appear to be effective. The presently preferred such substance is 3 hydroxy propyl methacrylate. Other examples are "HEMA"—2 hydroxy ethyl methacrylate, the former is presently preferred.

Examples of ionic lithium salts which contain oxygen are the perchlorate and nitrate. These are preferred not only because of their substantial oxygen content, but because of their relatively light weights.

Examples of suitble polyols are 1-mononitroglycerine; 2-mononitro glycerine; ethlyene glycol, propylene glycol (1,2 propane diol), 1, 3 butane diol; 1, 4 butane diol; and in some circumstances, glycerol.

Additional specific impulse can be provided by adding finely powdered lithium metal, aluminum metal, hexahydro -1,3,5 trinitro-s-triazine (RDX) or octahydro -1,3,5,7-tetranitro-1,3,5,7 tetrazocine (HMX) in useful amounts. For example, aluminum metal up to the amount of about 24% of the total weight of the product can be added.

The above additives will be stirred in after the initial mixing of the acrylic and the polyol substances.

The presently-preferred product is 3 hydroxy propyl methacrylate;

1-mononitroglycerine and 2-mononitroglycerine in equal proportions; and lithium perchlorate in the following mole ratio 1:1:3. When mixed and cured as described above, it is a useful propellant with an excellant specific impulse.

The proportions and substances can be varied as described above, and additives can be introduced as desired.

One purpose of adding glycerine is to change the glass transition temperature, because a propellant shall preferably not be in the glass phase, while an explosive should be. Increasing the glycerine hardens the product.

When aluminum is added to the mixture in an appropriate amount, specific impulse values as high as 285 lb. sec/lb. can be attained.

The product can be ignited by liquids or other suitable very hot igniters to function variously as explosives and propellants, releasing substantial amounts of energy. The basic mixture can be altered, as stated above, and even forms an intermediate for the production of other products.

The products are very shelf-stable, and are not ignitable by shock waves.

This invention is not to be limited by the embodiments described in the description, which are given by way of example and not of limitation, but only in accordance with the scope of the appended claims. We claim:

1. A propellant composition comprising the product obtained by curing an initially liquid or liquified mixture consisting essentially of:

(a) 3 hydroxy propyl methacrylate;

(b) an equal mixture of 1-mononitroglycerine and 2-mononitroglycerine; and (c) lithium perchlorate, in such proportions that (a) and (b) when mixed assimilates (c), and when cured forms an energetic composition which is ignitable to produce hot gases.

* * * * *